United States Patent [19]

Shaw

[11] 4,056,389

[45] Nov. 1, 1977

[54] NICKEL-CHROMIUM HIGH STRENGTH CASTING

[75] Inventor: Stuart Walter Ker Sutton Shaw, Coldfield, England

[73] Assignee: The International Nickel Company, Inc., New York, N.Y.

[21] Appl. No.: 254,728

[22] Filed: May 18, 1972

[30] Foreign Application Priority Data

May 20, 1971 United Kingdom ..... 16046/71

[51] Int. Cl.[2] ..... C22C 19/05

[52] U.S. Cl. ..... 75/171; 75/134 F; 148/32.5; 148/162

[58] Field of Search ..... 75/171, 170, 134 F; 148/32, 32.5, 162

[56] References Cited

U.S. PATENT DOCUMENTS 3,617,263 11/1971 Fontaine et al. ..... 75/171

*Primary Examiner*—R. Dean

*Attorney, Agent, or Firm*—Raymond J. Kenny; Ewan C. MacQueen

[57] ABSTRACT

Cast alloys containing correlated percentages of chromium, cobalt, niobium, titanium, aluminum, carbon, zirconium, boron, hafnium, etc., offer a good combination of stress-rupture life and impact strength at elevated temperatures.

3 Claims, No Drawings

NICKEL-CHROMIUM HIGH STRENGTH CASTING

The subject invention is directed to articles and parts cast from nickel-chromium alloys, and particularly to such articles and parts that are subject in use to stress at high temperatures under very corrosive conditions.

In U.S. Pat. No. 3,617,263 certain nickel-base alloys are described containing from 27 to 31% chromium, 10 to 25% cobalt, 0.2 to 2% niobium, both titanium and aluminum in a total amount from 2.25 to 4.5% with the ratio therebetween being from 1:1 to 4:1, 0.02 to 0.1% carbon, 0.002 to 0.01% boron and certain optional constituents.

It was found that as the combined content of niobium, titanium, aluminum and chromium increased, there was a great decrease in the resistance of these alloys, in the wrought form, to embrittlement, as measured by the impact resistance after prolonged exposure to service temperatures. In addition, there was little or no improvement in the stress-rupture lives of the wrought alloys. For such reasons, these elements were further restricted so that $$5\,(\%\ Nb) + 4\,(\%\ Ti + \%\ Al) + 2/3\,(\%\ Cr)$$

did not exceed 40%.

The present invention is based on the discoveries that with further increase in the combined contents of niobium, titanium and aluminum the stress-rupture lives of these alloys in the cast form are increased to a most marked extent while still retaining adequate resistance to embrittlement. Furthermore, even in the substantial absence of boron, which is an essential constituent of the above discussed alloys, the instant alloys not only afford very high stress-rupture lives, but also exhibit surprisingly good weldability under conditions of severe restraint.

Generally speaking, the present invention contemplates articles and parts cast from alloys containing (by weight) from 27 to 31% chromium, from 10 to 25% cobalt, from 0 to 1.9% niobium, both titanium and aluminium in a total amount from 3.5 to 5.5%, with the provisos that the ratio of titanium to aluminum is from 1:1 to 4:1 and that the sum of $$5\,(\%\ Nb) + 6\,(\%\ Ti + \%\ Al) + 2/3\,(\%\ Cr)$$

is from 49 to 54, from 0.02 to 0.2% carbon, from 0 to 0.6% zirconium, and from 0 to 1.2% hafnium, with the value of $$\%\ Zr + 0.5\,(\%\ Hf)$$

being not more than 0.6%, from 0 to 0.02% boron, and from 0 to 0.2% in total of yttrium and/or lanthanum, the balance, apart from impurities, being nickel.

In striving for a superior combination of properties, the chromium content of the alloys is advantageously from 27.5 to 30%, the cobalt from 16 to 22%, to niobium from 0.2 to 1.8%, and the carbon from 0.03 to 0.15%. The best combination of stress-rupture life at 9 tons/square inch (139 MN/m$^2$) at 870° C. and room temperature impact strength after heating for 1000 hours at 850° C. is exhibited by alloys containing from 28 to 29% chromium, 19 to 21% cobalt, 0.4 to 1.7% niobium, 0.04 to 0.08% carbon, with a Ti:Al ratio of from 1.5:1 to 2.5:1. Most advantageously, the niobium content is at least 0.75%. For the highest stress-rupture lives the zirconium content is preferably from 0.02 to 0.2% and the boron content from 0.003 to 0.01%.

However, if the castings are to be welded the zirconium level should not exceed 0.025% and the percentage of boron should not exceed 0.002%. To achieve the best impact strength in these substantially zirconium- and boron-free alloys, the niobium content is most preferably at least 1%. The optimum combination of properties including weldability is obtained in alloys containing from 28 to 29% chromium, from 19 to 21% cobalt, from 1.5 to 1.7% niobium, from 0.04 to 0.08% carbon, from 3.75 to 4.1% titanium plus aluminum, with Ti:Al ratio of 1.5:1 to 2.5:1, no more than 0.025% zirconium and no more than 0.002% boron, the balance being nickel.

In carrying the invention into practice and to develop the full stress-rupture properties of the alloys, they should be subjected to a heat-treatment comprising solutiong heating and subsequent aging. The solution treatment may consist of heating from 1 to 8 hours in the temperature range of 1050° C. to 1200° C. and the alloys may then be aged by heating for from 1 to 24 hours in the temperature range of b 600° to 950° C. An intermediate aging treatment consisting of heating for from 1 to 16 hours at 800° to 1050° C. may be interposed between the solution treatment and the final aging stages. The alloys may be cooled at any convenient rate after each heat treatment, e.g., by air cooling (generally to room temperature) or by direct transfer from a furnace at one temperature to one at a lower temperature. A particularly suitable heat treatment consists of solution heating for 4 hours at 1150° C., followed by air cooling and aging for 16 hours at 850° C. and finally again air cooling. Very useful properties are, however, exhibited by the alloys in the as-cast condition.

The importance of correlating the contents of niobium, titanium, aluminum and chromium so that the value of the "correlated factor"

$$5\,(\%\ Nb) + 6\,(\%\ Ti + Al) + 2/3\,(\%\ Cr)$$ lies between 49 and 54 is shown by the results of numerous tests set forth in Table I.

All the alloys were vacuum melted and test pieces were machined from cast blanks of the given composition which had been heat treated by solution heating for 4 hours at 1150° C. and air cooling, followed by aging for 16 hours at 850° C. and again air cooling. For each alloy, the stress-rupture life and elongation obtained in stress-rupture tests under a stress of 9 t.s.i. at 870° C. and the impact strength at room temperature after heating for 1000 hours at 850° C. are given in the last three columns. The impact strength was determined by the Charpy method using un-notched test pieces of 0.45 inch diameter. The values are in Joules.

It will be seen from Table I that Alloys 1 to 6, which were in accordance with the invention and for which the value of the "Correlated Factor" was between 49 and 54, exhibited much superior combinations of stress-rupture and impact properties than Alloys A to K inclusive, which were not in accordance with the invention and had values outside the 49 to 54 range. Generally speaking, the boron and zirconium-containing alloys in accordance with the invention had stress-rupture lives at 9 t.s.i. and 870° C of at least about 800 hours in combination with an impact strength of at least about 27 Joules. The stress-rupture test piece of Alloy No. 2, which broke after it has been subjected to a stress of 9 t.s.i. at 870° C for 1282 hours was examined microscopically and found to be free from sigma phase.

The alloys of the invention can be air-melted, but to ensure the best stress-rupture properties they are preferably melted and cast under vacuum.

TABLE I

| Alloy No. | Composition (% by weight)* C | Cr | Co | Nb | Ti | Al | Ti = Al | Zr | B | Correlated Factor | Stress-rupture 9 t.s.i./870° C Life hrs. | El. % | Impact strength after 1000h/850° C., Joules |
|---|---|---|---|---|---|---|---|---|---|---|---|---|---|
| A | 0.057 | 28.4 | 20.4 | 2.1 | 2.6 | 1.55 | 4.15 | .065 | 0.004 | 54.3 | 1.255 | 8.2 | 19 |
| B | 0.056 | 28.4 | 20.3 | 3.1 | 2.35 | 1.40 | 3.75 | 0.070 | 0.004 | 56.9 | 295 | 1.7 | 9.5 |
| C | 0.054 | 28.4 | 20.3 | 3.1 | 2.6 | 1.60 | 4.20 | 0.070 | 0.004 | 59.6 | 184 | 2.5 | 4 |
| D | 0.059 | 28.5 | 20.4 | 1.65 | 2.1 | 1.10 | 3.20 | 0.065 | 0.004 | 46.5 | 447 | 14.4 | — |
| E | 0.059 | 28.5 | 20.4 | 2.15 | 2.0 | 1.15 | 3.15 | 0.065 | 0.004 | 48.7 | 380 | 6.5 | 45 |
| F | 0.049 | 28.5 | 20.1 | 0.53 | 2.65 | 1.42 | 4.07 | 0.065 | 0.003 | 46.1 | 578 | 6.8 | 147 |
| G | 0.050 | 28.2 | 20.1 | 1.10 | 2.40 | 1.43 | 3.83 | 0.070 | 0.003 | 47.3 | 581 | 19.2 | 162 |
| H | 0.056 | 28.3 | 20.1 | 1.15 | 3.20 | 1.77 | 4.97 | 0.070 | 0.004 | 54.5 | 843 | 4.8 | 8 |
| 1 | 0.058 | 28.3 | 20.3 | 1.60 | 2.30 | 1.44 | 3.74 | 0.065 | 0.004 | 49.3 | 851 | 17.0 | 139 |
| 2 | 0.058 | 28.3 | 20.3 | 1.60 | 2.65 | 1.67 | 4.32 | 0.065 | 0.004 | 52.8 | 1,282 | 10.3 | 53 |
| 3 | 0.051 | 28.1 | 20.6 | 0.94 | 2.82 | 1.60 | 4.42 | 0.060 | 0.003 | 49.9 | 1,379 | 15.3 | — |
| 4 | 0.060 | 28.1 | 19.6 | 0.52 | 3.1 | 1.75 | 4.85 | 0.10 | 0.005 | 50.4 | 1,034 | 4.6 | 136 |
| 5 | 0.060 | 28.1 | 19.6 | 0.52 | 3.3 | 1.95 | 5.25 | 0.095 | 0.005 | 52.8 | 1,279 | 3.6 | 30 |
| 6 | 0.042 | 28.5 | 20.1 | — | 3.3 | 1.7 | 5.0 | 0.075 | 0.004 | 49.0 | 947 | 6.5 | 152 |
| I | 0.057 | 28.4 | 20.4 | 2.1 | 2.35 | 1.40 | 3.75 | 0.065 | 0.004 | 51.9 | 793 | 4.8 | 31 |
| J | 0.053 | 28.5 | 20.4 | 1.5 | 3.15 | 1.80 | 4.95 | 0.065 | 0.004 | 56.2 | 740 | 7.4 | — |
| K | 0.051 | 28.2 | 19.6 | 0.75 | 2.5 | 1.25 | 3.75 | 0.06 | 0.004 | 46.0 | 478 | 12.8 | 145 |

*balance nickel and impurities

The superior weldability of alloys substantially free from zirconium and boron is shown by tests carried out on other alloys according to the invention, Alloys Nos. 7 and 8 having the nominal composition:

| Alloy No. | Composition (% by wt) C | Cr | Co | Nb | Ti | Al | Ti+Al | Zr | B | Ni |
|---|---|---|---|---|---|---|---|---|---|---|
| 7 | 0.06 | 28.5 | 20.0 | 1.6 | 2.5 | 1.4 | 3.9 | <0.02 | <0.002 | bal |
| 8 | 0.06 | 28.5 | 20.0 | 0.50 | 3.3 | 1.7 | 5.0 | <0.02 | <0.002 | bal |

Apart from the boron and zirconium, the compositions of Alloy No. 7 is very similar to that of Alloy No. 1 and the composition of Alloy No. 8 is very similar to Alloy Nos. 4 and 5. In butt-welding tests using matching filler rods under severely restrained conditions such that test pieces of Alloy Nos. 1, 4 and 5 would crack, test pieces of Alloy Nos. 7 and 8 remained crack-free.

The stress-rupture and impact properties of Alloy Nos. 7 and 8 under the same conditions as those for the alloys in Table I are set forth in Table II.

TABLE II

| Alloy No. | Stress-rupture 139 MN/m²/870° C Life (h) | El (%) | Impact Strength after 1000h/850° C (J) |
|---|---|---|---|
| 7 | 807 | 9.0 | 99 |
| 8 | 882 | 2.4 | 11 |

It will be seen that under these tests conditions Alloy No. 7 had a stress-rupture life of 807 hours, which is only slightly less than the life of 852 hours for Alloy No. 1 under the same conditions. Alloy No. 8, which contained only 0.5% niobium, had a stress-rupture life of 882 hours, which, although somewhat inferior to those of Alloy Nos. 4 and 5, is still very good, but had an impact strength of 11 Joules which is inferior to that of Alloy Nos. 4 and 5 but still acceptable.

Further results for the boron- and zirconium-free Alloy No. 7 confirm the excellent stress-rupture properties of this alloy under various test conditions.

TABLE III

| Stress (MN/m²) | Temp(° C) | Life (h) | Elongation |
|---|---|---|---|
| 170 | 870 | 183 | 8.6 |
| 124 | 870 | 1277 | 5.6 |
| 263 | 815 | 213 | 6.6 |
| 193 | 815 | 1713 | 7.6 |

In addition to their excellent combination of stress-rupture and impact properties, the alloys of the invention also exhibit high resistance to corrosion when exposed to a molten mixture of 25% by weight of sodium chloride and 75% sodium sulphate at 900° C.

Although the alloys are primarily intended for use in the cast form as blades and other components of gas turbine engines, particularly stator blades, they are suitable for use in other applications where a combination of good stress-rupture strength and resistance to crorosion is required, particularly for articles and parts that are subject in use to stress at high temperatures while exposed to the combustion products of impure hydrocarbon fuels or to salt or both.

Although the present invention has been described in conjuction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A cast nickel-chromium alloy characterized by a good combination of stress-rupture strength at temperatures of 850° C. or higher together with marked resistance to embrittlement upon prolonged exposure to such temperature, and also good weldability, said alloy consisting of from 27 to 31% chromium, 10 to 25% cobalt, up to 1.9% niobium, titanium and aluminum in a total amount of 3.5 to 5.5%, the ratio of titanium to aluminum being from 1:1 to 4:1 and with the niobium, titanium, aluminum and chromium being correlated such that the "Correlated Factor" of 5 (% Nb) + 6 (% Ti + Al) + 2/3 (% Cr) is more than 49 and up to 54, 0.02 to 0.2% carbon, up to 0.025% zirconium, up to 1.2% hafnium with the %Zr + 1/2 (% Hf) not exceeding 0.6%, up to 0.002% boron, up to 0.2% of yttrium and/or lanthanum, the balance being essentially nickel.--

2. A cast alloy in accordance with claim 1 containing at least 1% niobium.

3. A cast alloy in accordance with claim 1 containing from 28 to 29% chromium, from 19 to 21% cobalt, from 1.5 to 1.7% niobium, from 0.04 to 0.08% carbon, titanium and aluminum in a total amount of 3.75 to 4.1%, the ratio of titanium to aluminum being from 1.5:1 to 2.5:1.

* * * * *